US008419503B2

(12) United States Patent
Zhang

(10) Patent No.: US 8,419,503 B2
(45) Date of Patent: Apr. 16, 2013

(54) CUSHIONED BRASSIERE

(75) Inventor: Wen Bo Zhang, Kwai Chung (HK)

(73) Assignee: Regina Miracle International Enterprises Limited, Kwai Chung (HK)

( * ) Notice: Subject to any disclaimer, the term of this patent is extended or adjusted under 35 U.S.C. 154(b) by 432 days.

(21) Appl. No.: 12/484,419

(22) Filed: Jun. 15, 2009

(65) Prior Publication Data

US 2010/0317256 A1 Dec. 16, 2010

(51) Int. Cl.
*A41C 3/00* (2006.01)

(52) U.S. Cl.
USPC ..... 450/41; 450/39

(58) Field of Classification Search ..... 450/39, 450/41, 47, 49, 45, 48, 51–53, 54–58; 2/255, 2/256, 258, 260, 26.1, 264
See application file for complete search history.

(56) References Cited

U.S. PATENT DOCUMENTS 3,114,374 A * 12/1963 Chalfin et al. ..... 450/41
3,209,756 A * 10/1965 Rowell ..... 450/52
3,605,753 A * 9/1971 Schwartz ..... 450/52
4,945,571 A * 8/1990 Calvert ..... 2/467
6,811,464 B2 * 11/2004 Li ..... 450/57
6,824,444 B2 * 11/2004 Huang ..... 450/57
6,837,771 B2 * 1/2005 Falla ..... 450/39
6,857,934 B2 * 2/2005 Chan ..... 450/41
6,896,580 B2 5/2005 Falla et al.
7,131,888 B2 * 11/2006 Hsu ..... 450/39
7,179,150 B2 2/2007 Luk et al.
7,207,861 B2 4/2007 Martini
7,390,239 B1 * 6/2008 Huang ..... 450/39
7,407,427 B2 * 8/2008 Liu ..... 450/39
7,429,205 B1 * 9/2008 Huang ..... 450/39
7,458,877 B2 * 12/2008 Yu ..... 450/39
7,563,152 B2 * 7/2009 Liu ..... 450/39
7,604,526 B2 * 10/2009 Liu ..... 450/39

FOREIGN PATENT DOCUMENTS

JP 2006-124893 5/2006

OTHER PUBLICATIONS

English translation of relevant section (Reference 1) of a Technical Opinion issued by the Japanese Patent Office on Jun. 14, 2011.

* cited by examiner

*Primary Examiner* — Gloria Hale
(74) *Attorney, Agent, or Firm* — Ostrolenk Faber LLP

(57) ABSTRACT

A molded brassiere cup is disclosed in which an underwire is located between sheets of material which provide the outer and inner surfaces of the brassiere cup. During manufacture an insert of a cushioning substance, preferably a piece of foam, is located between the inner sheet of material and the underwire. The invention avoids prior art complex casing structures for underwires and is cheaper to manufacture.

21 Claims, 2 Drawing Sheets

CUSHIONED BRASSIERE

FIELD OF THE INVENTION

The present invention relates generally to brassieres and in particular to a single molded brassiere cup, a molded brassiere cup assembly, a brassiere and a method of manufacturing.

BACKGROUND

A conventional brassiere comprises a pair of breast cups intended to support the breasts of the wearer, a connecting portion joining together the inner edges of the cups at the wearer's cleavage, and at least one strap or back wing that extends from outer edges of the breast cups around the back of the wearer. The brassiere may further include shoulder straps that extend from upper edges of the breast cups over the shoulders of the wearer to attachment points on the back wing crossing the wearer's back.

A brassiere may include an underwire for each breast cup to shape and support the lower periphery of each breast cup. An underwire may comprise a generally U-shaped frame formed from metal or a rigid plastic material. Usually a pair of underwires is incorporated into a brassiere or other undergarment to provide shape and support for a pair of breast cups. However, in some forms the underwire may comprise a single underwire frame which traverses both breast cups.

U.S. Pat. No. 6,896,580 B2 and U.S. Pat. No. 7,207,861 B2 disclose cushioned underwires for brassieres, in which the underwire and the cushioning material are provided in multi-layered casings. These casings are complex in structure and thus relatively expensive in the overall costs for manufacture of a brassiere.

SUMMARY OF THE INVENTION

According to a first aspect the present invention provides a molded brassiere cup comprising an outer layer of fabric, an inner layer of fabric and an underwire, wherein the inner fabric layer and the outer fabric layer are molded to form the brassiere cup with the underwire sandwiched therebetween, wherein an insert of a cushioning substance is located between the inner fabric layer and the underwire for reducing pressure of the underwire against a wearer's body.

The invention avoids the rather complex casing structures of the prior art which have incorporated the underwire. Thus, in the invention, the underwire and the cushioning substance are separately provided, with the cushioning substance being preferably provided via a piece of foam which is readily molded into the brassiere cup form during manufacture of the brassiere cup. Thus costs are reduced.

According to another aspect of the invention there is provided a brassiere comprising:

two molded breast cups each including an outer foam layer, an inner foam layer and an underwire, wherein the outer foam layer and the inner foam layer are molded to form the breast cup with the underwire sandwiched therebetween, an intermediate bridging region extending between the two breast cups, and a back strap extending from an outer region of each of the two breast cups, wherein an insert of a cushioning substance is located between the inner foam layer and the underwire for reducing pressure of the underwire against a wearer's body.

According to yet another aspect of the invention there is provided a method of manufacturing a molded brassiere cup comprising the steps of:

i) providing a first sheet of material comprising a layer of fabric which is to be an outer layer of the brassiere cup, ii) molding the first sheet of material to impress a breast cup form into the sheet of material, iii) locating an underwire on the first sheet of material adjacent the breast cup form, iv) covering the underwire with an insert of a cushioning substance, v) providing a second sheet of material comprising a layer of fabric which is to be an inner layer of the brassiere cup, and vi) molding together the first and second sheets of material to laminate the sheets to provide the molded brassiere cup wherein the underwire is sandwiched between the sheets with the insert of the cushioning substance located between the second sheet of material and the underwire.

Although the insert of cushioning substance is preferably a piece of foam, or possibly a double layer of foam to provide a thicker cushion, it may alternatively be provided via a silicon gel, a fibre mass, or a bladder or sac filled with a fluid such as a liquid or air.

Preferably the outer fabric layer is a ply of a multiply sheet and the multiply sheet may comprise the fabric layer with a foam layer laminated thereto. Also preferably, the inner fabric layer is a ply of a multiply sheet and the multiply sheet comprises at least two layers, namely the fabric layer and a foam layer laminated to the fabric layer. However, the invention is also applicable to a molded brassiere cup without foam layers laminated to either the inner or outer fabric layers.

The invention also includes a molded finished cup assembly (that is, a molded assembly comprising two brassiere cups) and also a brassiere which may be formed from the molded cup assembly.

For a better understanding of the invention and to show how the same may be performed, embodiments thereof will now be described, by way of non-limiting example only, with reference to the accompanying drawings.

DETAILED DESCRIPTION OF EMBODIMENTS

Figures 1, 2, 3, 5:
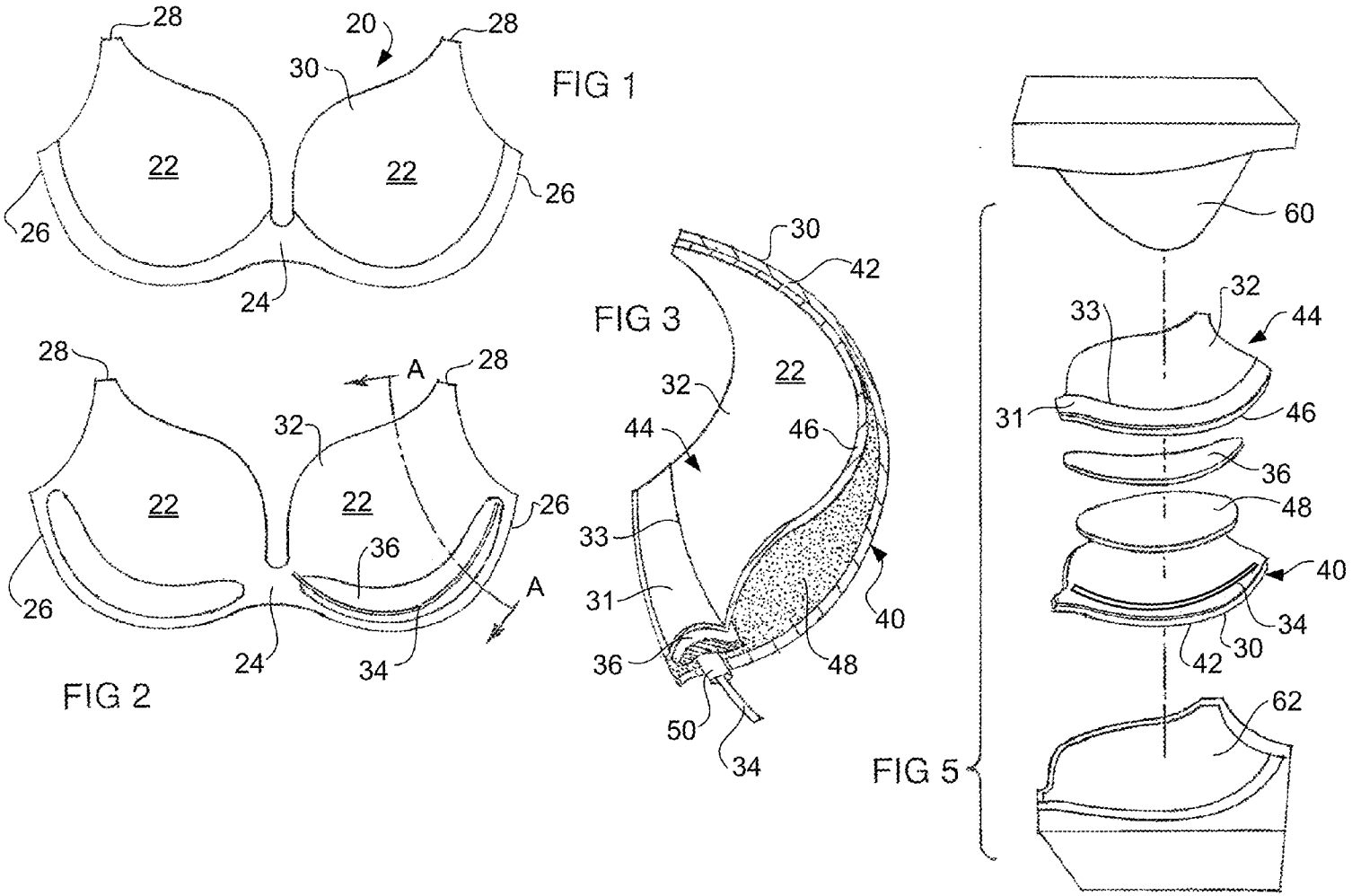
FIG. 1 is a front view of an edge finished molded brassiere cup assembly according to an embodiment of the invention.
FIG. 2 is a back view of the cup assembly of FIG. 1 indicating the placement of an underwire and foam insert for one of the brassiere cups.
FIG. 3 is an isometric sectioned view of a brassiere cup along section AA of FIG. 2.
FIG. 5 is an exploded view of the final manufacturing step of FIG. 4.

Referring to FIG. 1, a molded edge finished cup assembly 20 for a brassiere comprises a pair of breast cups 22 joined by a connecting portion 24. To form a brassiere a strap or back wing (not shown) may be attached, for example by sewing or other non-sewing means such as molding or welding or otherwise, to the cup assembly 20 to extend from the outer edge of each brassiere cup 22 (for example from region 26) to around the back of the wearer and a shoulder strap (not shown) may be attached to an upper extension 28 on each brassiere cup 22 to an attachment location on each back strap or wing.

The cup assembly 20 comprises an outer fabric layer 30 (see FIG. 1) and an inner fabric layer 32 (see FIG. 2), that is, the inner fabric layer 32 contacts the skin of a wearer.

Referring to the rear view of the cup assembly 20 (see FIG. 2) the location of an underwire 34, at a lower edge region of a brassiere cup 22, is indicated for the right hand brassiere cup 22 (as viewed in the Figure), as is the location for an insert 36 of a cushioning substance, which in the embodiment is a piece of foam (note that in FIG. 2 the underwire 34 and insert 36 are shown in full outline instead of dashed outline for clarity). It can be seen from FIG. 3 that the insert 36 covers the underwire 34. The cushioning substance acts as a buffer to reduce the pressure of the underwire 34 against the wearer's body.

The structure of a brassiere cup 22 is shown by the FIG. 3 cross section. Thus it comprises a first sheet of material 40 which is a multiply laminate, namely a laminate of the outer fabric layer 30 and a foam layer 42. There is a second sheet of material 44 which is also a multiply laminate, namely a laminate of the inner fabric layer 32 and a foam layer 46. The lamination is for example accomplished with adhesives. Between the two sheets 40 and 44 is a foam cookie or padding 48. The cookies or padding 48 in each breast cup 22 may be omitted. The underwire 34 is sheathed in a fabric 50 and the insert 36 of a cushioning substance is located between the second sheet of material 44, which comprises the inner fabric layer 32, and the sheathed underwire 34. In a variation, though not the most preferred one, the cushioning substance could form or be part of the foam layer 46 which is laminated to the inner fabric layer 32, such that the thickness of the foam layer 46 increases or increases substantially, or that the foam layer 46 bulges, at or about a region corresponding to or covering the region where the underwire is located.

The fabric layers 30 and 32, and the foam layers 42 and 46, and the padding 48 if provided, may be fabrics and foams as disclosed in U.S. Pat. No. 7,179,150 B2, the contents of which are to be taken as incorporated herein by this cross-reference. This patent also discloses that the fabric of the underwire sheath 50 may be a tricot material. It also discloses how the laminated sheets 40 and 44 may be manufactured.

The underwire 34 may be of metal, coated metal, or other different materials as may be suitable, such as plastic or other polymeric materials. The underwire for each cup 22 must be rigid enough, particularly in the plane of the brassiere, to provide adequate support for the bust and yet flexible enough to conform to the wearer's body for comfort and appearance. The underwire 34 for each brassiere cup 22 may be formed of a relatively thin length of metal or polymeric material having a rectangular or rounded (for example, oval) cross-section. A reasonably stiff length of such material is bent into an appropriately curved shape and is sheathed by the tricot fabric 50 for placement in position during manufacture of the brassiere cups 22.

The second sheet of material 44 comprising the inner fabric layer 32 and the foam layer 46 may comprise two contiguous panels (each comprising fabric of a certain different characteristic, such as different color or hand feel, or pattern) joined to each other. One of the fabrics which may be patterned, or which may exhibit other characteristic different from the other fabric, may correspond generally to the region of the brassiere cup where the cushioned underwire is embedded or where the insert of a cushioning substance is located, that is, as indicated by reference 31 in FIG. 3. As illustrated, such a fabric has generally an elongate shape. Such a "different" fabric enhances aesthetic appeal and serves the function of indicating to the user the presence of a cushioned underwire or an embedded cushioning substance at the said region. The two panels are contiguous and preferably joined by ultrasonic welding. For example, the two-panel inner layer 32 may be formed by placing two precursor rectangular panels (each formed by laminating a fabric ply to a foam ply) one on top of the other (preferably with the foam plys of the panels facing each other so that the fabric plys are better welded), ultrasonically cutting the two panels along a line of cutting (this line is indicated by reference 33 in FIG. 3) so that the two panels are cut and welded at the same time along the line of cutting, and unfolding the two panels to obtain the second sheet of material 44. During the ultrasonic welding, the heat generated by the vibration frequency is sufficient to melt and weld the fabric materials but not the foam materials. Thus, at the cut line, the foam materials on either side of the cut will not be joined. The ultrasonically welded joint so formed between the two panels (which two panels will form the inner fabric layer 32) provides a smooth exterior surface on the inner side against the wearer's skin which is important or advantageous for enhancing the hand feel of the surface to be in contact with the wearer's skin and generally the comfort of the wearer. However, such a joint 33 may not be a very strong bond. Therefore, the line of welding corresponding to the above-mentioned line of cutting may preferably be covered by an additional foam layer (which is in addition to the foam ply laminated to the inner fabric layer 32) on the outer side in order to enhance the bond between the two panels.

Figure 4:
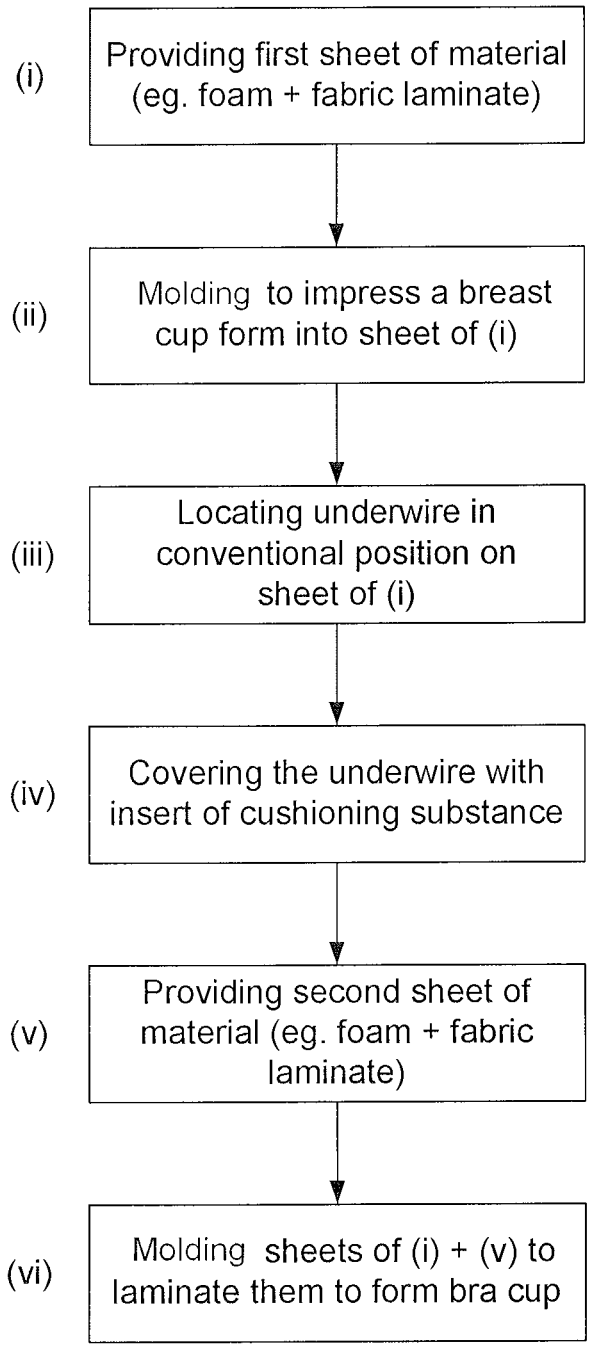
FIG. 4 is a flow chart illustrating the steps in a method of manufacture of a brassiere cup assembly according to an embodiment of the invention.

With reference to FIGS. 4 and 5, the first step (i) in a method of manufacturing a cup assembly 22 is to provide a first sheet of material 40, comprising a layer of what is to be the outer fabric layer 30 and then in step (ii) to use molds, for example a convex upper mold 60 and a concave lower mold 62 as shown in FIG. 5, to apply heat and pressure for a time to impress the two breast cup forms 22 into the first sheet of material 40. Temperature and times for such molding are disclosed in the above-referenced U.S. Pat. No. 7,179,150 B2. The next step (iii) is to locate and possibly fix in position on the rear surface of the first sheet 40 at a lower edge region of each cup form in that sheet, the sheathed underwire 34. The padding or cookie layer 48 of foam for each cup 22 may then be laid over the first sheet 40 within each already formed breast cup form. The insert 36 of a cushioning substance, preferably also a piece of foam, is then for each cup 22, laid over the sheathed underwire 34 to cover it (step (iv)). A second sheet of material 44 is then provided and located over the previously assembled parts (step (v)), and the whole assemblage is molded (step (vi)), using the molds 60 and 62 (see FIG. 5), to laminate the sheets to provide each molded brassiere cup 22. The temperature and time for this molding step (vi) are 180° C. to 200° C. and 120 seconds respectively. Prior to the molding to laminate the sheets to provide each molded brassiere cup, adhesives are applied to the surfaces to be laminated to facilitate the lamination. As a final step, the molded assemblage may be trimmed to provide the molded edge finished cup assembly 20 as illustrated by FIG. 1.

Instead of a two cup assembly 20 as described above, the invention is intended to encompass the provision of a single brassiere cup 22, which may be manufactured using the same steps as above but in respect of a single stand alone brassiere cup 22. The invention is also intended to cover the provision and manufacture of a molded one-piece brassiere of the type described in U.S. Pat. No. 7,179,750 B2. For such a one-piece brassiere as described in U.S. Pat. No. 7,179,750 B2 which includes a core cup assembly comprising an outer foam layer and an inner foam layer laminated to each other and defining two breast cups, the first sheet of material described in the foregoing corresponds to the outer foam layer of the core cup assembly as described in U.S. Pat. No. 7,179,750 B2, and the second sheet of material described in the foregoing corresponds to the inner foam layer of the core cup assembly as described therein, and the insert of a cushioning substance described in the foregoing is located between the inner foam layer of the core cup assembly described therein and the sheathed underwire described therein. In this case, neither the first sheet of material nor the second sheet of material needs to include a fabric layer. Instead, as described in U.S. Pat. No. 7,179,750 B2, the core cup assembly is encased by an outer exterior layer (which includes a fabric layer) and an inner exterior layer (which includes a fabric layer) each laminated with the core cup assembly on a respective side thereof, wherein each of the outer and inner exterior layers extends beyond a perimeter of the core cup assembly to provide at least a part of the brassiere's back strap or wing.

Although use of a piece of foam for the insert 36 is preferred, other alternative cushioning substances that may be used are a silicon gel, fibre fill, or a bladder or sac filled with air or a liquid. It is also possible to use two or more inserts of a cushioning substance (or different cushioning substances), preferably pieces of foam which may for each brassiere cup 22 be layered one on the other to enhance the cushioning effect.

Besides reducing manufacturing costs, the invention also provides other advantages. For example, different sized cushioning inserts may be used, depending upon the requirements of different users. Variations in cushion sizes are easily achievable during a manufacturing process, for example by varying the size of the cushioning substance, or by varying the mold design in the case of moldable cushioning material.

The invention described herein is susceptible to variations, modifications and/or additions other than those specifically described which would be obvious to a person of skill in the art and it is to be understood that the invention includes all such variations, modifications and/or additions which fall within the scope of the following claims.

The invention claimed is:

1. A molded brassiere cup comprising:

an outer layer of fabric including a first foam layer laminated thererto, an inner layer of fabric including a second foam layer laminated thererto, and an underwire sheathed in a wire casing, wherein the inner fabric layer and the outer fabric layer are molded to form the brassiere cup with the underwire sandwiched therebetween, wherein an insert of a cushioning substance is located between the inner fabric layer and the underwire for reducing pressure of the underwire against a wearer's body, the inner fabric layer, the second foam layer and the insert of cushioning configured to provide a substantially semicircular protrusion extending inward along a bottom of the brassiere cup.

2. A molded brassiere cup as claimed in claim 1, wherein the insert is a piece of foam.

3. A molded brassiere cup as claimed in claim 1, wherein the insert is a silicon gel.

4. A molded brassiere cup as claimed in claim 1, wherein the insert is a fiber mass.

5. A molded brassiere cup as claimed in claim 1, wherein the insert is a bladder filled with a fluid.

6. A molded brassiere cup as claimed in claim 5, wherein the fluid is a liquid.

7. A molded brassiere cup as claimed in claim 5, wherein the fluid is air.

8. A molded brassiere cup as claimed in claim 1, wherein the outer fabric layer is a ply of a multiply sheet.

9. A molded brassiere cup as claimed in claim 8, wherein the multiply sheet comprises a foam layer laminated to the outer fabric layer.

10. A molded brassiere cup as claimed in claim 1, wherein the inner fabric layer is a ply of a multiply sheet.

11. A molded brassiere cup as claimed in claim 10, wherein the multiply sheet comprises a foam layer laminated to the inner fabric layer.

12. A molded brassiere cup as claimed in claim 1, wherein the underwire is sheathed in a fabric.

13. A molded brassiere cup as claimed in claim 1, wherein the inner layer of fabric comprises a first panel of fabric and a second panel of fabric which are contiguous and joined to each other by ultrasonic welding.

14. A molded brassiere cup as claimed in claim 13, wherein the second panel of fabric corresponds generally to a region of the molded brassiere cup where the insert of a cushioning substance is located.

15. A molded brassiere cup assembly comprising two molded brassiere cups, each as claimed in claim 1.

16. A brassiere comprising a molded brassiere cup assembly as claimed in claim 15, having a back strap or wing attached thereto for attachment of the brassiere to a wearer's body.

17. A brassiere comprising:

two molded breast cups each including an outer foam layer with a first foam layer laminated thereto, an inner foam layer with a second foam layer laminated thereto and an underwire sheathed in a wire cover, wherein the outer foam layer and the inner foam layer are molded to form the breast cup with the underwire sandwiched therebetween, an intermediate bridging region extending between the two breast cups, and a back strap extending from an outer region of each of the two breast cups, wherein an insert of a cushioning substance is located between the inner foam layer and the underwire for reducing pressure of the underwire against a wearer's body, the inner fabric layer, the second foam layer and the insert of cushioning configured to provide a substantially semicircular protrusion extending inward along a bottom of the brassiere cup.

18. A method of manufacturing a molded brassiere cup comprising the steps of:

providing a first sheet of material comprising a layer of fabric which is to be an outer layer of the brassiere cup, the outer layer including a first foam layer laminated thereto, molding the first sheet of material to impress a breast cup form into the sheet of material, locating an underwire on the first sheet of material adjacent the breast cup form, the underwire sheathed in a wire cover, covering the underwire with an insert of a cushioning substance, providing a second sheet of material comprising a layer of fabric which is to be an inner layer of the brassiere cup, the inner layer including a second foam layer laminated thereto, and molding together the first and second sheets of material to laminate the sheets to provide the molded brassiere cup wherein the underwire is sandwiched between the sheets with the insert of the cushioning substance located between the second sheet of material and the underwire, the inner fabric layer, the second foam layer and the insert of cushioning configured to provide a substantially semicircular protrusion extending inward along a bottom of the brassiere cup.

19. A method as claimed in claim 18, including providing a piece of foam as the insert.

20. A method as claimed in claim 18, wherein in step iii) the underwire is fixed in position on the first sheet of material.

21. A method as claimed in claim 18, wherein in step iv) the insert of a cushioning substance is fixed in position covering the underwire.

* * * * *

UNITED STATES PATENT AND TRADEMARK OFFICE

CERTIFICATE OF CORRECTION

PATENT NO. : 8,419,503 B2
APPLICATION NO. : 12/484419
DATED : April 16, 2013
INVENTOR(S) : Wen Bo Zhang It is certified that error appears in the above-identified patent and that said Letters Patent is hereby corrected as shown below:

On the Title Page:

Item (73) Assignee, should read: Regina Miracle International (Group) Limited

Signed and Sealed this
Eighteenth Day of June, 2013

Teresa Stanek Rea
*Acting Director of the United States Patent and Trademark Office*